US010294652B2

(12) United States Patent
Erlebach

(10) Patent No.: US 10,294,652 B2
(45) Date of Patent: May 21, 2019

(54) PIPE TRAP ASSEMBLY

(71) Applicant: Josef Erlebach, Silverthorne, CO (US)

(72) Inventor: Josef Erlebach, Silverthorne, CO (US)

( * ) Notice: Subject to any disclaimer, the term of this patent is extended or adjusted under 35 U.S.C. 154(b) by 0 days.

(21) Appl. No.: 15/711,356

(22) Filed: Sep. 21, 2017

(65) Prior Publication Data

US 2018/0171609 A1 Jun. 21, 2018

Related U.S. Application Data

(60) Provisional application No. 62/434,579, filed on Dec. 15, 2016.

(51) Int. Cl.
*E03C 1/20* (2006.01)
*E03F 5/04* (2006.01)
*E04B 1/70* (2006.01)

(52) U.S. Cl.
CPC ..... *E03F 5/0407* (2013.01); *E03C 1/20* (2013.01); *E03F 5/0408* (2013.01); *E04B 1/7023* (2013.01)

(58) Field of Classification Search
CPC .... E03C 1/20; E03D 11/16; E03F 2005/0413; E03F 5/0407–5/0408; F16L 55/00
USPC ..... 285/58; 4/252.4–252.5
See application file for complete search history.

(56) References Cited

U.S. PATENT DOCUMENTS 3,048,911 A * 8/1962 Almon ..... E04G 15/00 138/89
3,420,522 A * 1/1969 Elliott ..... A63G 11/00 472/110
3,547,471 A * 12/1970 Dunmire ..... F16L 21/04 285/337
3,579,670 A * 5/1971 Emil ..... E03D 11/16 285/56
3,700,381 A * 10/1972 Deeke ..... E03C 1/20 4/288
4,052,759 A * 10/1977 Hill ..... E03D 11/16 285/56
4,306,738 A * 12/1981 Lindquist ..... E03F 5/0407 285/140.1
4,492,391 A * 1/1985 Haines ..... F16L 21/08 285/114
4,502,166 A * 3/1985 Brown, Sr. ..... E03D 11/16 285/56
4,827,539 A * 5/1989 Kiziah ..... E03D 11/16 285/303
5,190,320 A * 3/1993 Hodges ..... E03D 11/16 285/338
8,109,539 B2 * 2/2012 Krohn ..... F16L 17/00 285/322
9,290,925 B2 * 3/2016 Majocka ..... E03F 5/0407
2005/0166315 A1 * 8/2005 Warnecke ..... E03F 5/0407 4/695

(Continued)

*Primary Examiner* — David P Angwin
*Assistant Examiner* — Nicholas A Ros
(74) *Attorney, Agent, or Firm* — Leyendecker & Lemire, LLC

(57) ABSTRACT

A pipe trap assembly is described. Embodiments of the pipe trap assembly can include a first plate, a second plate, and a plurality of fasteners. The second plate can include two or more protrusions extending inwardly from an interior edge of an opening in the second plate. The protrusions can be implemented to frictionally engage a waste line. In one example, the pipe trap assembly can be used to secure a waste line for coupling to a drain base of a drain assembly.

7 Claims, 9 Drawing Sheets

(56) References Cited

U.S. PATENT DOCUMENTS

2010/0133159 A1* 6/2010 Priester ..... E03F 5/0408
210/163

* cited by examiner

PIPE TRAP ASSEMBLY

CROSS-REFERENCE TO RELATED APPLICATION

This application claims the benefit of U.S. Provisional Application No. 62/434,579, filed Dec. 15, 2016.

BACKGROUND

Connecting a drain base to a waste line above a trap waste line and solvent welding the pieces together (or no-caulk) can be time consuming, adding unnecessary costs. Of note, the two pieces need to be coupled through a relatively small hole in a subfloor, often without any access from below, can be challenging especially when the waste line is not independently stabilized. For instance, the waste line can be secured to floor joists or the subfloor. In some instances, a bottom of the trap must be shimmed and rest on a dry walled ceiling below, thus pushing the drain base against and over the waste line causing the waste line to be pushed downwardly making a secure and fully engaged connection difficult to achieve. However, securing the waste line to the joists or subfloor prior to determining the exact location of the drain is pointless as a secured location will rarely be coincident with the waste line and the lower flange ring. A poorly secured joint between the lower flange ring and the waste line can result in leaks and/or separation of the parts at some future point in time.

DETAILED DESCRIPTION

Figure 1A:
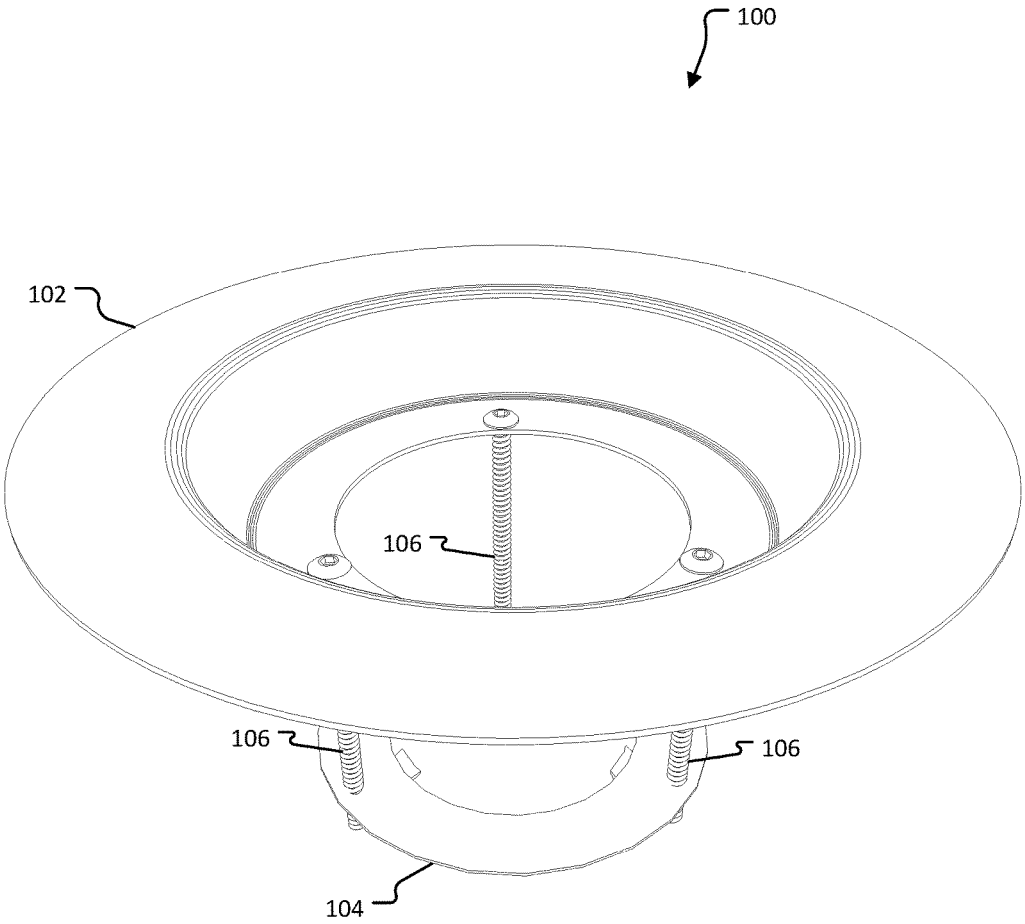
FIG. 1A is an isometric view of a pipe trap assembly according to one embodiment of the present invention.

Embodiments of the present invention include a pipe trap assembly. The pipe trap assembly can be implemented to help stabilize a waste line when installing a drain assembly in a shower stall. The pipe trap assembly can include, but is not limited to, a first plate, a second plate, and a plurality of fasteners. In one embodiment, the first plate can be adapted to fit partially into a hole in a subfloor. Typically, at least a portion of the plate can interface with an area surrounding the hole in the subfloor. The second plate can be implemented to couple to a waste line and the plurality of fasteners can be implemented to remotely couple the second plate to the first plate. In one instance, the second plate can be implemented as a locking ring. For example, the second plate can be substantially ring shaped and configured to lock (or couple) to a pipe of a waste line.

In a typical implementation, the pipe trap assembly can be placed in a hole in a subfloor of a shower stall. Generally, the hole can be located approximate a waste line. An installer can then slide the second plate over and down the waste line. As the second plate slides down the waste line, protrusions on an interior of the second plate can elastically bend upwardly and frictionally engage the waste line. The protrusions can be implemented to prevent the waste line from sliding freely downwardly. The protrusions can effectively prevent the second plate from being moved upwardly relative to the waste line by digging into the waste line and locking in place when an upward force is applied to the second plate. The waste line can then be solvent bonded to a drain base or can be coupled to a no-caulk drain base. Of note, the plurality of fasteners can be used to bring the waste line to a correct height for coupling to a drain base. For instance, by tightening the fasteners, the second plate can be moved upward relative to the first plate. The waste line can move with the second plate as the fasteners are tightened.

U.S. patent application Ser. No. 15/706,387, filed Sep. 15, 2017 is hereby incorporated in its entirety by reference.

Terminology

The terms and phrases as indicated in quotation marks (“ ”) in this section are intended to have the meaning ascribed to them in this Terminology section applied to them throughout this document, including in the claims, unless clearly indicated otherwise in context. Further, as applicable, the stated definitions are to apply, regardless of the word or phrase’s case, to the singular and plural variations of the defined word or phrase.

The term “or” as used in this specification and the appended claims is not meant to be exclusive; rather the term is inclusive, meaning either or both.

References in the specification to “one embodiment”, “an embodiment”, “another embodiment, “a preferred embodiment”, “an alternative embodiment”, “one variation”, “a variation” and similar phrases mean that a particular feature, structure, or characteristic described in connection with the embodiment or variation, is included in at least an embodiment or variation of the invention. The phrase “in one embodiment”, “in one variation” or similar phrases, as used in various places in the specification, are not necessarily meant to refer to the same embodiment or the same variation.

The term "couple" or "coupled" as used in this specification and appended claims refers to an indirect or direct physical connection between the identified elements, components, or objects. Often the manner of the coupling will be related specifically to the manner in which the two coupled elements interact.

The term "directly coupled" or "coupled directly," as used in this specification and appended claims, refers to a physical connection between identified elements, components, or objects, in which no other element, component, or object resides between those identified as being directly coupled.

The term "approximately," as used in this specification and appended claims, refers to plus or minus 10% of the value given.

The term "about," as used in this specification and appended claims, refers to plus or minus 20% of the value given.

The terms "generally" and "substantially," as used in this specification and appended claims, mean mostly, or for the most part.

Directional and/or relationary terms such as, but not limited to, left, right, nadir, apex, top, bottom, vertical, horizontal, back, front and lateral are relative to each other and are dependent on the specific orientation of a applicable element or article, and are used accordingly to aid in the description of the various embodiments and are not necessarily intended to be construed as limiting.

An Embodiment of a Pipe Trap Assembly

Figure 1B:
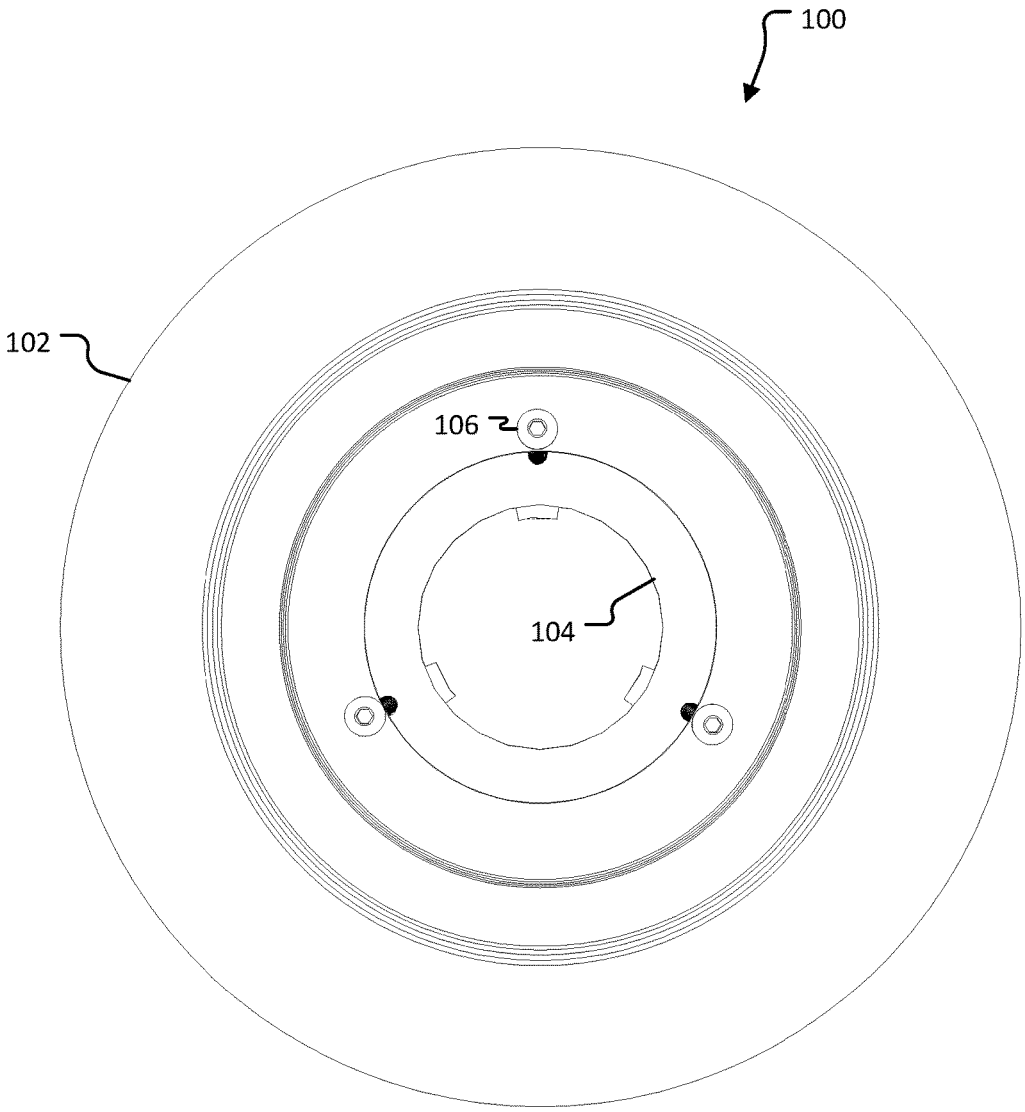
FIG. 1B is a top view of a pipe trap assembly according to one embodiment of the present invention.

Referring to FIGS. 1A-1B, detailed diagrams of an embodiment 100 of a pipe trap assembly are illustrated. FIG. 1A is an isometric view of the pipe trap assembly 100 and FIG. 1B is a top view of the pipe trap assembly 100. Generally, the pipe trap assembly 100 can be implemented to stabilize a waste line for coupling to a drain base of a drain assembly in a shower stall.

The pipe trap assembly 100 can include, but is not limited to, a first plate 102, a second plate 104, and a plurality of fasteners 106. The plurality of fasteners 106 can be implemented to remotely couple the second plate 104 to the first plate 102. As shown in FIG. 1B, the first plate 102 and the second plate 104 can be concentrically coupled together.

Of note, the plates 102, 104 can be one of several different shapes and sizes. Typically, the plates 102, 104 can be manufactured from a relatively thin rigid plate and formed into various different structures and/or shapes. The plates 102, 104 can typically be comprised of a metal. In one example, the plates 102, 104 can be manufactured from stainless steel. As can be appreciated, the plates 102, 104 can be comprised of other suitable semi-rigid and rigid materials.

Figure 2A:
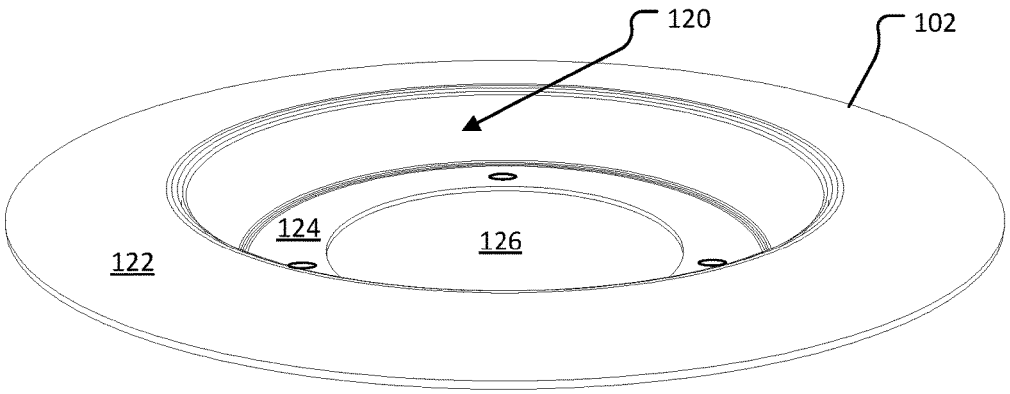
FIG. 2A is an isometric view of a first plate of a pipe trap assembly according to one embodiment of the present invention.
Figure 2B:
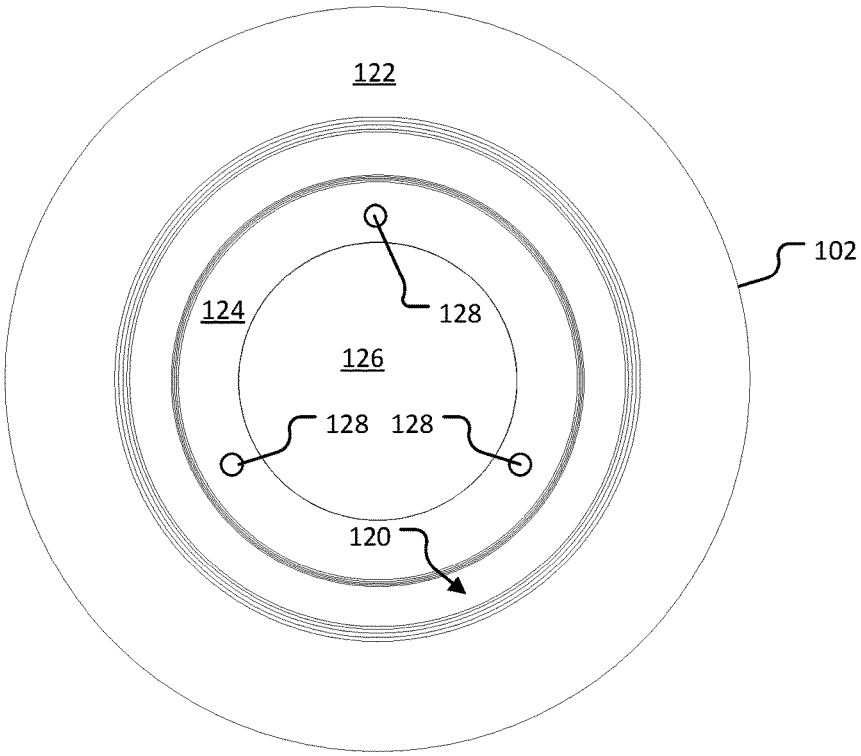
FIG. 2B is a top view of a first plate of a pipe trap assembly according to one embodiment of the present invention.

Referring to FIGS. 2A-2B, detailed diagrams of one embodiment of the first plate 102 are illustrated. FIG. 2A is an isometric view of the first plate 102 and FIG. 2B is a top view of the first plate 102.

Figure 7A:
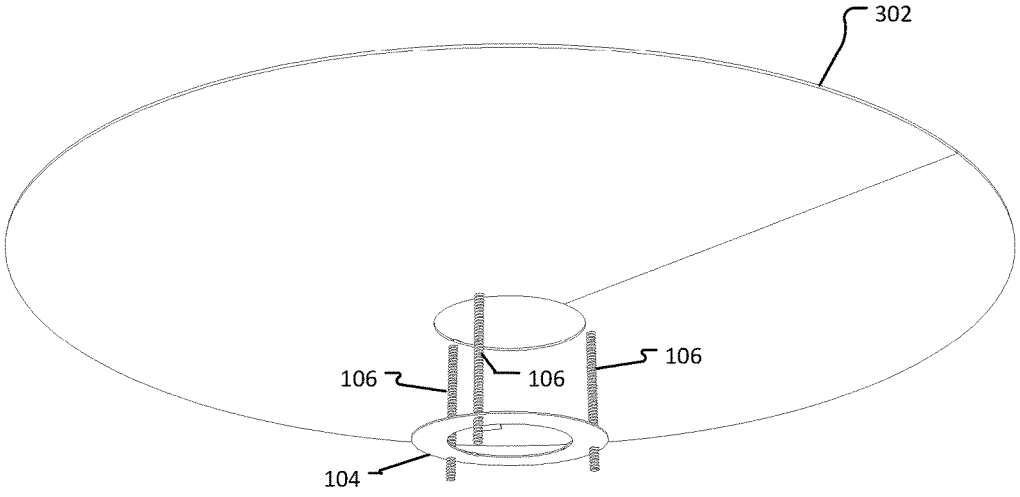
FIG. 7A is a bottom perspective view of a pipe trap assembly including an alternative first plate according to one embodiment of the present invention.
Figure 7B:
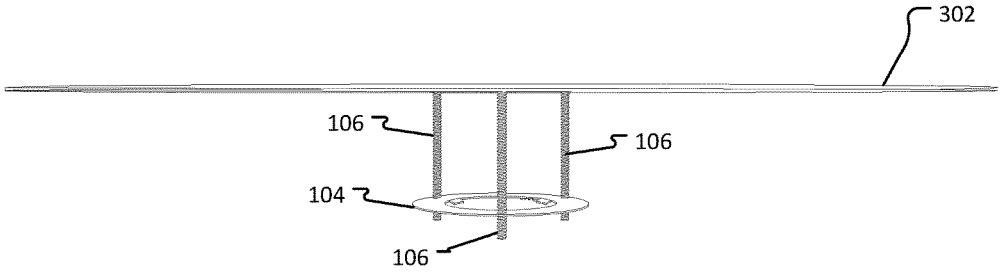
FIG. 7B is a side view of a pipe trap assembly including an alternative first plate according to one embodiment of the present invention.

In one embodiment, the first plate 102 can have a substantially frustoconical shape that can be characterized by a cylindrical recess 120 that can be adapted to fit into a hole prepared in a subfloor. The first plate 102 can be supported in the hole by a substantially horizontal radial flange 122 that extends outwardly from a top of the recess 120. A bottom of the recess 124, which can be located a predetermined distance below the surface of the subfloor, can include a central opening 126 configured to receive a drain base (not shown) there through. In another embodiment, the first plate 102 can be defined by a substantially flat plate with a hole (or opening) located approximate a middle of the plate, as shown in FIGS. 7A-7B. Of significant note, a general shape of the first plate 102 and associated opening 126 can be altered without exceeding a scope of the present invention.

Referring back to FIGS. 2A-2B, to attach to the second plate 104, the bottom of the recess 124 can include a plurality of holes 128 adapted to receive one of the plurality of fasteners 106. For illustrative purposes only, three holes are shown generally in each of the FIGS. 1-7B. In one example, the three holes 128 can be located outwardly of the central opening 126 and can be spaced apart approximately 120 degrees from each other with each being sized to receive one of the plurality of fasteners 106 there through. Typically, each of the holes 128 can be can be positioned at locations a first radial distance from a center axis of the first plate 102. Variations with two fastener holes or four fastener holes are also contemplated. Typically, the first plate 102 can be adhesively secured to a subfloor, mechanically fastened to the subfloor, and/or just set in place.

Figure 3A:
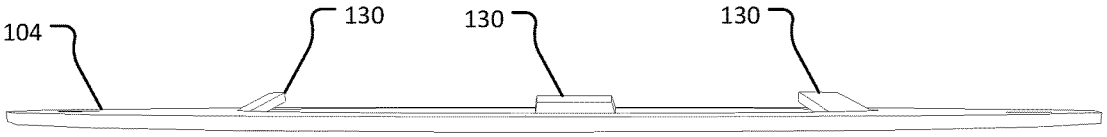
FIG. 3A is a side view of a second plate of a pipe trap assembly according to one embodiment of the present invention.
Figure 3B:
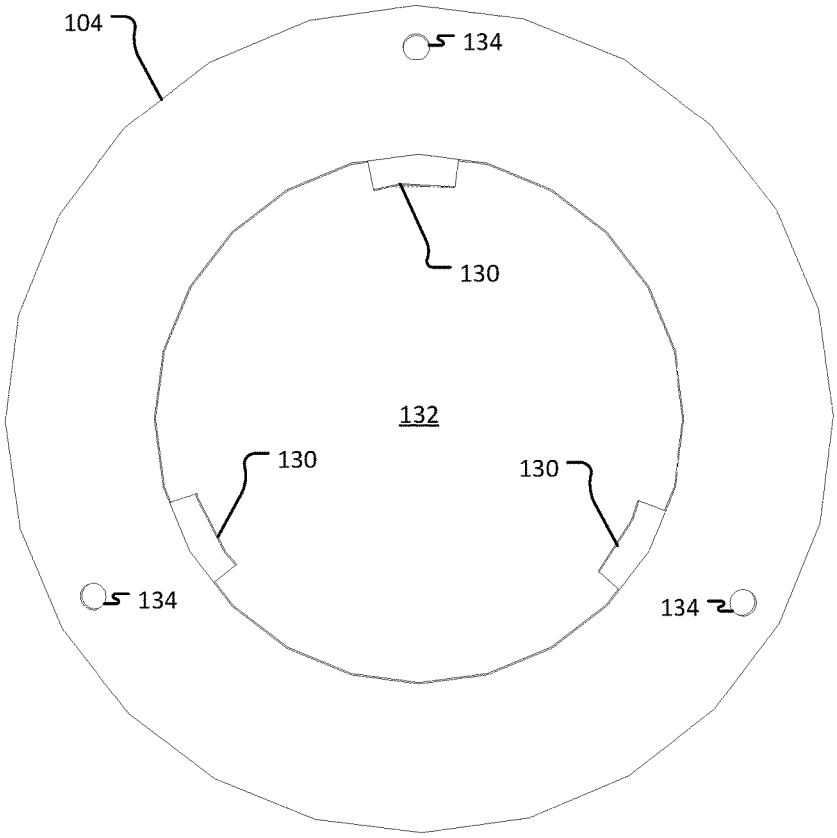
FIG. 3B is top view of a second plate of a pipe trap assembly according to one embodiment of the present invention.

Referring to FIGS. 3A-3B, detailed diagrams of the second plate 104 are illustrated. FIG. 3A is a side view of the second plate 104 and FIG. 3B is a top view of the second plate 104.

In one embodiment, as shown in FIG. 3B, the second plate 104 can be a disc including two or more protrusions 130 that extend inwardly from a interior edge of a hole (or opening) 132 located approximate a center of the disc 104. Typically, the second plate 104 can be manufactured from a single piece of rigid material. For instance, the protrusions 130 can be an integral part of the second plate 104. In some instances, the protrusions 130 can be coupled to the second plate 104. For example, the protrusions 130 may be comprised of a more flexible material than the second plate 104 and can be directly coupled to the second plate 104. Of note, the second plate 104 can be one of several different shapes that include a hole having two or more protrusions, as shown generally in FIGS. 8A-8C.

The hole 132 can typically have a circular shape, but other shapes are contemplated. For instance, the hole 132 may have a substantially square shape with protrusions extending substantially inward from interior sides of the square hole. In another instance, the hole 132 may have a triangular shape. As shown generally in the figures, three protrusions 130 are shown for illustrative purposes only and are not meant to be limiting. Embodiments including two protrusions or four or more protrusions are contemplated.

As shown in FIG. 3A, the disc 104 can be substantially flat. The disc 104 can include a plurality of holes 134, with each of the holes 134 adapted to receive one of the plurality of fasteners 106. The plurality of holes 134 can be positioned at locations a first radial distance from a center axis of the disc 104. As can be appreciated, the first radial distance from the center axis of the disc 104 can be approximately equal to the first radial distance from the center axis of the first plate 102.

The protrusions 130 can be implemented to interface with a waste line. In a typical implementation, as the disc 104 slides down a waste line, the protrusions 130 can elastically bend upwardly and frictionally engage the waste line preventing the waste line from sliding freely downwardly. The protrusions 130 can effectively prevent the disc 104 from being moved upwardly relative to the waste line by digging into the waste line and locking in place when an upward force is applied to the disc 104. Typically, an effective diameter of an opening defined by inside edges of the protrusions 130 can be less than an exterior diameter of an associated waste line. Of note, regardless of a shape of the hole 132, interior edges of the protrusions 130 can define a circumference slightly smaller than a circumference of an associated waste line.

As shown in FIG. 3A, each of the protrusions 130 can be canted upwards. Typically, the protrusions 130 can be manufactured from a semi-flexible material. For instance, the protrusions 130 can be manufactured from spring steel. In one instance, the protrusions 130 can be biased slightly upwards such that when a waste line passes through the second plate 104, the protrusions 130 can bend slightly. For example, the protrusions 130 can be configured to elastically deform when moved upwards. The protrusions 130 can be bent upwards to prevent a waste line from sliding down. When a waste line tries to move down, edges of the protrusions 130 can dig into and frictionally engage the waste line, thus preventing the waste line from moving downwards. For instance, the waste line may want to sag with the weight of a trap and water and a length of a horizontal portion of the waste line after the trap.

Figure 4:
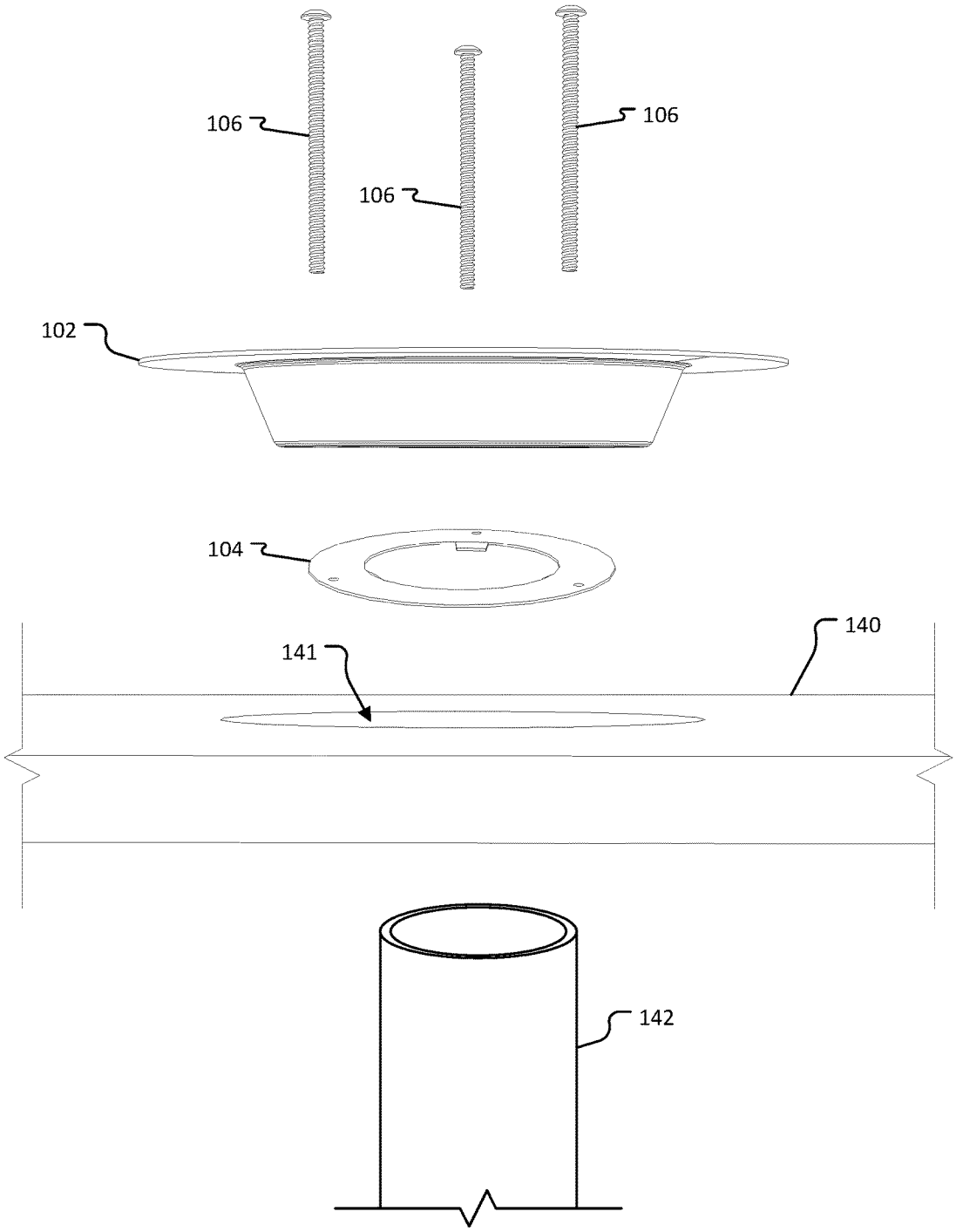
FIG. 4 is an exploded view of a pipe trap assembly according to one embodiment of the present invention.

Referring to FIG. 4, an exploded view of the pipe trap assembly 100, a subfloor 140, and a waste line 142 is illustrated. In a typical implementation, the plurality of fasteners 106 can be passed through each of the plurality of holes 128 of the first plate 102 and can couple with the plurality of holes 134 of the disc 104. The first plate 102 can be adapted to fit into and interface with a surrounding of a hole 141 cut into the subfloor 140. In some instances, the first plate 102 can be sized to fit with a plurality of differently sized drain bases. Typically, the hole 141 can be cut approximate a location of the waste line 142. In some instances, the hole 141 can be cut to match a diameter and depth of a drain base being used.

Figure 5:
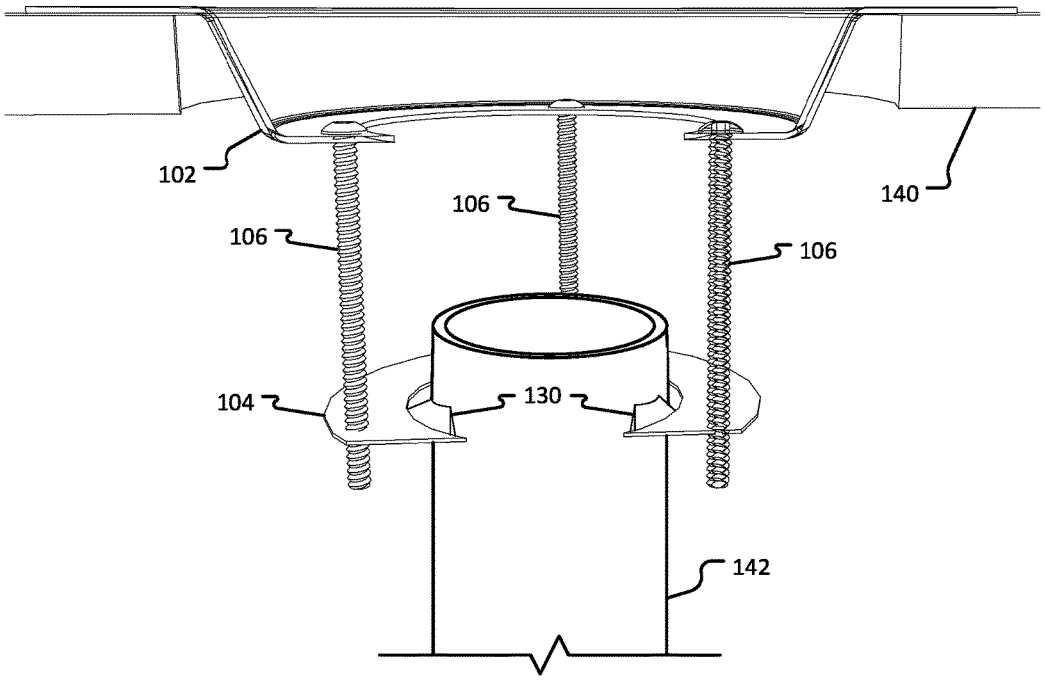
FIG. 5 is a partial cross-sectional view of a pipe trap assembly according to one embodiment of the present invention.

Referring to FIG. 5, a partial cross-sectional view of the subfloor 140 and the waste line 142 interfacing with the components 102-106 of the pipe trap assembly 100 is illustrated. Of note, the protrusions 130 of the disc 104 can be bent upwards as the waste line 142 is passed through the opening 132 of the disc 104. As previously mentioned, the protrusions 130 can be adapted to elastically deform when deflected upwards. As the disc 104 is passed down over the waste line 142, the protrusions 130 can allow the waste line 142 to pass through the opening 132 of the disc 104. In contrast, when the waste line 142 is pressed down, possibly by a drain base of a drain assembly, the protrusions 130 can dig into and frictionally engage the waste line 142, thus stopping the waste line 142 from moving down.

Figure 6:
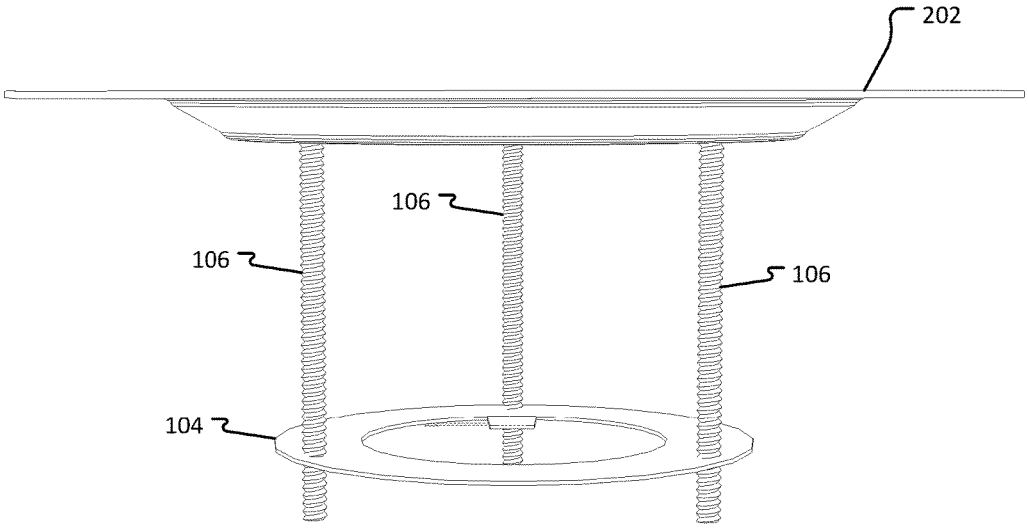
FIG. 6 is a side view of a pipe trap assembly including an alternative first plate according to one embodiment of the present invention.

Referring to FIG. 6, a detailed diagram of a second embodiment 202 of a first plate is illustrated. The second embodiment first plate 202 can include components substantially similar to the first embodiment first plate 102. For instance, the second embodiment first plate 202 can include a central opening and a plurality of holes to receive the plurality of fasteners 106. As shown, the second embodiment first plate 202 can include a substantially similar structure to the first embodiment first plate 102, but a recess of the first plate 202 can be shorter in height than the first embodiment first plate 102. For instance, the first plate 202 can have a substantially shallow frustoconical shape.

Referring to FIGS. 7A-7B, detailed diagrams of a third embodiment 302 of a first plate are illustrated. The third embodiment first plate 302 can include a plurality of holes for receiving the plurality of fasteners 106 and can include a central opening for receiving a drain assembly. As shown in FIGS. 7A-7B, the third embodiment first plate 302 can be a substantially flat circular plate. As can be appreciated, a shape of the first plate 302 can be changed without exceeding a scope of the present invention. Of note, the base plate 302 can be sized to interface with an area surrounding a hole in a subfloor to provide support to the disc 104.

Figure 8A:
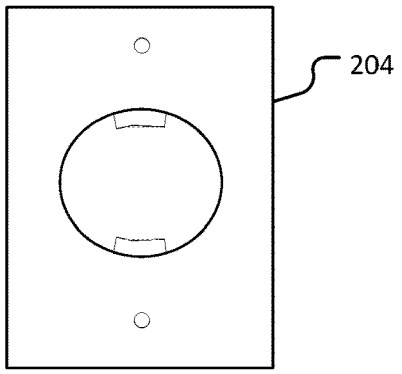
FIG. 8A is a top view of an alternative second plate according to one embodiment of the present invention.
Figure 8B:
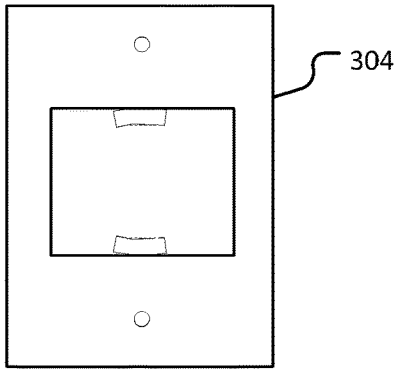
FIG. 8B is a top view of an alternative second plate according to one embodiment of the present invention.
Figure 8C:
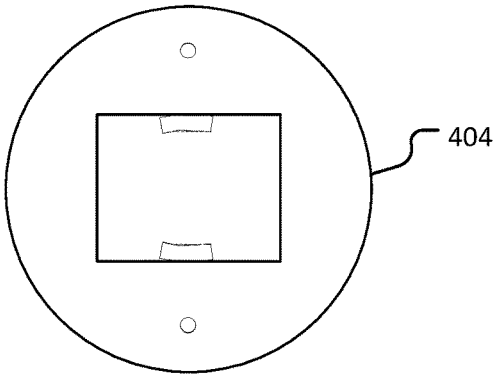
FIG. 8C is a top view of an alternative second plate according to one embodiment of the present invention.

Referring to FIGS. 8A-8C, detailed diagrams of various alternative embodiments 204, 304, 404 of the second plate are illustrated. As shown in FIG. 8A, the second plate 204 can have a substantially rectangular shape with a substantially circular opening. As shown in FIG. 8B, the second plate 304 can have a substantially rectangular shape with a substantially rectangular opening. As shown in FIG. 8C, the second plate 404 can have a substantially circular shape with a substantially square opening. Of significant note, a general shape of the second plate 104 and associated opening can be altered without exceeding a scope of the present invention.

Alternative Embodiments and Variations

In some alternative embodiments, the first plate can be remotely coupled to the second plate at a fixed distance. For instance, thin rigid plates can extend down from the first plate and can be coupled to the second plate providing a fixed distance between the first plate and the second plate. In another instance, rigid rods can extend down from the first plate and be coupled to the second plate. As can be appreciated, a plurality of different means for remotely coupling the second plate to the first plate at a fixed distance are contemplated and the provided examples are not meant to be limiting.

In some alternative embodiments, the first plate and the second plate can be combined into a unitary device. For instance, a unitary plate can have a substantially frustoconical shape including a long (or deep) recess. The recess can be configured to extend down below a hole in a subfloor. An opening of the unitary plate at a bottom of the recess can include two or more protrusions for interfacing with a waste line. As can be appreciated, as the unitary plate is inserted into the hole in the subfloor, the waste line can pass through the opening and can be frictionally engaged by the protrusions, similar to the previously described second plate.

In some alternative embodiments, the second plate can be a pipe including at least two tabs extending out from an exterior of the pipe. The pipe can be configured to be solvent welded to a waste line. The at least two tabs can include holes for coupling to a fastener first passed through the first plate. As can be appreciated, the pipe can first be solvent welded to the waste line. Once the pipe is securely coupled to the waste line, the first plate can be placed in a hole in the subfloor. The plurality of fasteners can then be passed through the holes of the first plate and coupled to the holes in the tabs of the pipe.

In some alternative embodiments, a pipe having a diameter bigger than a diameter of a waste line can be coupled to the first plate. The pipe can extend down from the first plate and include protrusions on an interior of the pipe similar to the previously described protrusions for interfacing with the waste line. Typically, the protrusions can be located proximate a bottom of the pipe. In some instances, the pipe can be removably coupled to the first plate. For example, the pipe may have threads on an exterior of the pipe that can threadably couple to the opening of the first plate. In other instances, the pipe can be coupled to the first plate in a fixed position.

The various embodiments and variations thereof, illustrated in the accompanying Figures and/or described above, are merely exemplary and are not meant to limit the scope of the invention. It is to be appreciated that numerous other variations of the invention have been contemplated, as would be obvious to one of ordinary skill in the art, given the benefit of this disclosure. All variations of the invention that read upon appended claims are intended and contemplated to be within the scope of the invention.

I claim:

1. A pipe trap assembly comprising:

a first plate having a substantially frustoconical shape defined by (i) a cylindrical recess, (ii) a substantially horizontal radial flange extending outwardly from a top of the cylindrical recess adapted to interface with an area surrounding a hole in a subfloor, and (iii) a bottom surface including at least two holes and a central opening;

a second plate including:

a central hole;

at least two protrusions extending inwardly from a circumferential edge of the central hole; and at least two holes;

a plurality of fasteners adapted to pass through the at least two holes on the bottom of the first plate and couple to the at least two holes of the second plate;

wherein the second plate (i) is remotely coupled to the first plate at a distance, and (ii) does not interface with the subfloor when coupled to the first plate.

2. The pipe trap assembly of claim 1, wherein the at least two holes of the first plate are each located a first radial distance from a center axis of the first plate.

3. The pipe trap assembly of claim 2, wherein the at least two holes of the second plate are each located the first radial distance from a center axis of the second plate.

4. The pipe trap assembly of claim 1, wherein a waste line is adapted to pass through the central hole of the second plate.

5. The pipe trap assembly of claim 4, wherein an effective diameter of an opening defined by inside edges of the at least two protrusions is less than an exterior diameter of the waste line.

6. The pipe trap assembly of claim 1, wherein each of the plurality of fasteners are threaded.

7. The pipe trap assembly of claim 6, wherein the at least two holes of the second plate are threaded and are adapted to mate with the plurality of fasteners.

* * * * *